US008746527B2

(12) United States Patent
Laubach et al.

(10) Patent No.: US 8,746,527 B2
(45) Date of Patent: Jun. 10, 2014

(54) HIGH EFFICIENCY PNEUMATIC NAILER

(75) Inventors: Marco Laubach, Wheeling, IL (US); Yizhuo Zhang, Arlington Heights, IL (US)

(73) Assignee: Robert Bosch GmbH, Stuttgart (DE)

( * ) Notice: Subject to any disclaimer, the term of this patent is extended or adjusted under 35 U.S.C. 154(b) by 282 days.

(21) Appl. No.: 13/281,513

(22) Filed: Oct. 26, 2011

(65) Prior Publication Data

US 2013/0105540 A1 May 2, 2013

(51) Int. Cl.
*B25C 1/04* (2006.01)

(52) U.S. Cl.
USPC ..... 227/8; 227/130

(58) Field of Classification Search
USPC ..... 227/8, 10, 130
See application file for complete search history.

(56) References Cited

U.S. PATENT DOCUMENTS

| | | | | |
|---|---|---|---|---|
| 3,152,519 | A | 10/1964 | Doyle | |
| 3,498,517 | A * | 3/1970 | Novak | 227/8 |
| 4,030,655 | A | 6/1977 | Rothfuss et al. | |
| 5,522,532 | A * | 6/1996 | Chen | 227/8 |
| 5,687,897 | A * | 11/1997 | Fa et al. | 227/8 |
| 5,850,961 | A * | 12/1998 | Braun et al. | 227/130 |
| 5,873,510 | A | 2/1999 | Hirai et al. | |
| 6,006,975 | A * | 12/1999 | Ishizawa | 227/119 |
| 6,745,928 | B2 * | 6/2004 | Ishizawa et al. | 227/130 |
| 6,779,699 | B2 * | 8/2004 | Aoki et al. | 227/130 |
| 7,014,089 | B2 * | 3/2006 | Ishizawa et al. | 227/130 |
| 7,296,721 | B1 | 11/2007 | Wen | |
| 7,341,174 | B1 | 3/2008 | Wen | |
| 7,395,954 | B2 | 7/2008 | Wen | |
| 7,448,524 | B1 | 11/2008 | Liang et al. | |
| 2004/0238590 | A1 | 12/2004 | Ishizawa et al. | |
| 2011/0192879 | A1 | 8/2011 | Zhang et al. | |

FOREIGN PATENT DOCUMENTS

JP 2010064225 A 3/2010

OTHER PUBLICATIONS

International Search Report in correspondence PCT application (i.e., PCT/US2012/061727), mailed Mar. 22, 2013 (11 pages).

* cited by examiner

*Primary Examiner* — Scott A. Smith
(74) *Attorney, Agent, or Firm* — Maginot, Moore & Beck

(57) ABSTRACT

A pneumatic nailer for use with a fluid source includes a housing, a cylinder, a first valve assembly, a piston, and a port assembly. The housing defines a storage chamber configured for fluid communication with the fluid source. The cylinder is configured for movement with respect to the housing between a first cylinder position and a second cylinder position. An inner side of the cylinder defines a sleeve chamber and an outer side of the cylinder and the housing defines an actuating chamber therebetween. The first valve assembly is connected to the cylinder and is configured to (i) to allow fluid flow from the sleeve chamber to the actuating chamber and (ii) to prevent fluid flow from the actuating chamber to the sleeve chamber. The piston has a piston head and a driver member extending from the piston head.

16 Claims, 4 Drawing Sheets

HIGH EFFICIENCY PNEUMATIC NAILER

FIELD

This patent relates generally to pneumatic tools and particularly to a pneumatic nailer.

BACKGROUND

Pneumatic tools are commonly used in the construction industry. One type of pneumatic tool is a pneumatic nailer, which is a tool that is used to drive nails into a workpiece. In a standard setting, a pneumatic nailer is coupled to a source of compressed air, typically from a portable air compressor. The pneumatic nailer usually includes a magazine that holds numerous fastening members, such as nails. The nails are typically arranged in a strip or a coil, in which the nails are uniformly spaced apart from each other and are loosely connected by a clip made from a thin layer of plastic, paper, and/or a resin-type material.

To drive a nail into a workpiece with the pneumatic nailer, the operator places an ejector tip of the nailer against the workpiece. After the tip is depressed, the nailer becomes responsive to force applied to a trigger of the nailer. When the trigger is depressed, the nailer activates a pneumatic actuating mechanism inside the nailer, which plunges a ramming member from a ready position toward one of the nails of the strip of nails. The ramming member strikes the nail and causes the nail to disengage from the strip of nails, exit through the ejector tip, and drive into the workpiece. When the operator releases the trigger or the ejector tip is removed from the workpiece, the pneumatic actuating mechanism quickly returns the ramming member to the ready position, where it remains until the sequence is repeated.

Some pneumatic nailers use compressed air to both drive the ramming member toward the nail and also to return the ramming member to the ready position. Generally, it is desirable for pneumatic nailers to efficiently utilize the supply of compressed when driving and returning the ramming member. The efficient use of the compressed air results in less power cycling of the air compressor, which not only conserves electrical power and/or reduces fuel consumption (depending on the type of air compressor), but also increases the operational life of the air compressor.

Therefore, a continuing need exists for a pneumatic nailer that efficiently uses compressed air to drive nails, and that also efficiently uses compressed air to return the ramming member to the ready position.

SUMMARY

According to one embodiment of the disclosure, a pneumatic nailer for use with a fluid source includes a housing, a cylinder, a piston, a second valve assembly, and an actuator. The housing defines a storage chamber configured for fluid communication with the fluid source. The cylinder has a sleeve, an actuating structure fixed to the sleeve, a first valve assembly connected to the sleeve, and a port assembly formed in the sleeve. The cylinder is configured for movement with respect to the housing between a first cylinder position and a second cylinder position. An inner side of the sleeve defines a sleeve chamber, and an outer side of the sleeve and the housing defines an actuating chamber therebetween on a first side of the actuating structure. The first valve assembly is configured to (i) to allow fluid flow from the sleeve chamber to the actuating chamber and (ii) to prevent fluid flow from the actuating chamber to the sleeve chamber. The piston has a piston head and a driver member extending from the piston head. The piston head is movable within the sleeve chamber between a first piston position and a second piston position. The sleeve and the piston head define (i) a displacement chamber on a first side of the piston head and (ii) a return chamber on an opposite side of the piston head. The port assembly is configured (i) to fluidly couple the return chamber to the actuating chamber when the cylinder is in the first cylinder position and (ii) to fluidly couple the return chamber to atmosphere when the cylinder is in the second cylinder position. The second valve assembly is at least partially positioned within the housing and is moveable between a first valve position and a second valve position. The second valve assembly is configured (i) to fluidly couple the displacement chamber to atmosphere when the second valve assembly is in the first valve position and (ii) to isolate the displacement chamber from atmosphere when the second valve assembly is in the second valve position. The actuator is positionable between an actuated position and a deactuated position and is configured such that (i) when the actuator is moved from the deactuated position to the actuated position the second valve assembly is caused to move from the first valve position to the second valve position and (ii) when the actuator is moved from the actuated position to the deactuated position the second valve assembly is caused to move from the second valve position to the first valve position.

According to another embodiment of the disclosure, a pneumatic nailer for use with a fluid source includes a housing, a cylinder, a first valve assembly, a piston, and a port assembly. The housing defines a storage chamber configured for fluid communication with the fluid source. The cylinder is configured for movement with respect to the housing between a first cylinder position and a second cylinder position. An inner side of the cylinder defines a sleeve chamber and an outer side of the cylinder and the housing defines an actuating chamber therebetween. The first valve assembly is connected to the cylinder and is configured (i) to allow fluid flow from the sleeve chamber to the actuating chamber and (ii) to prevent fluid flow from the actuating chamber to the sleeve chamber. The piston has a piston head and a driver member extending from the piston head. The piston head is movable within the sleeve chamber between a first piston position and a second piston position. The cylinder and the piston head define (i) a displacement chamber on a first side of the piston head and (ii) a return chamber on an opposite side of the piston head. The port assembly is formed in the cylinder and is configured (i) to fluidly couple the return chamber to the actuating chamber when the cylinder is in the first cylinder position and (ii) to fluidly couple the return chamber to atmosphere when the cylinder is in the second cylinder position.

BRIEF DESCRIPTION OF THE FIGURES

The above-described features and advantages, as well as others, should become more readily apparent to those of ordinary skill in the art by reference to the following detailed description and the accompanying figures in which.

DETAILED DESCRIPTION

Figure 1:
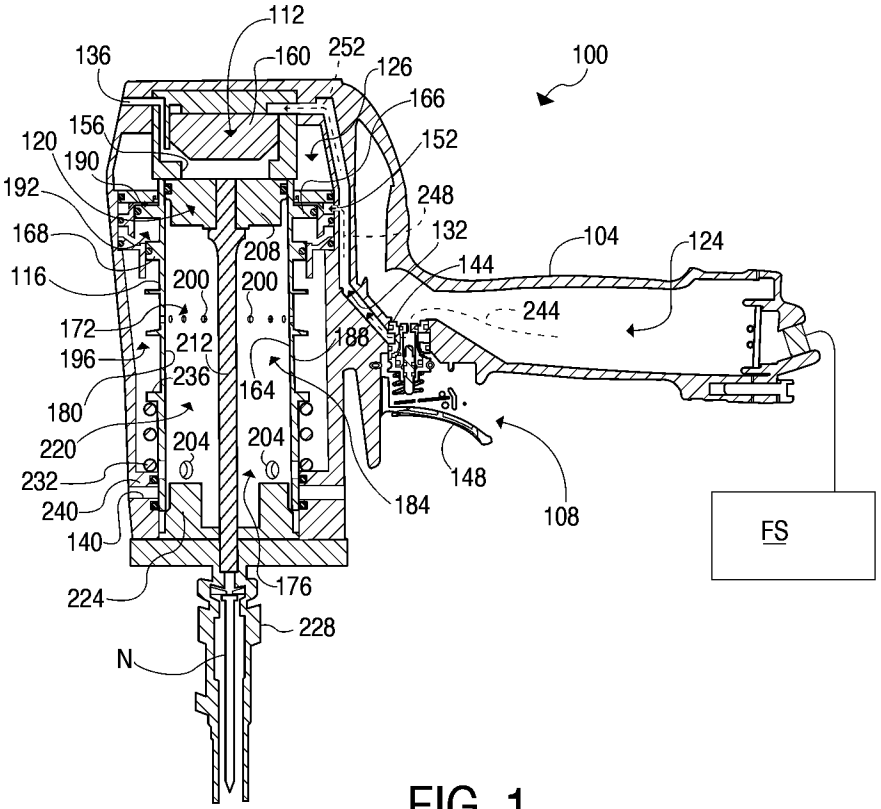
FIG. 1 is a cross sectional view of a pneumatic nailer, shown with a cylinder of the pneumatic nailer in a first cylinder position and a piston of the pneumatic nailer in a first piston position.

For the purpose of promoting an understanding of the principles of the invention, reference will now be made to the embodiments illustrated in the drawings and described in the following written specification. It is understood that no limitation to the scope of the invention is thereby intended. It is further understood that the invention includes any alterations and modifications to the illustrated embodiments and includes further applications of the principles of the invention as would normally occur to one skilled in the art to which this invention pertains.

As shown in FIG. 1, a pneumatic nailer 100 includes a housing 104, an actuator 108, a valve assembly 112, a cylinder 116, and a piston 120. The housing 104 defines a storage chamber 124, a storage chamber 126, a connection chamber 132, a vent passage 136, and a vent passage 140. The storage chamber 124 and the storage chamber 126 are fluidly coupled to each other and also fluidly coupled to a fluid source FS, which supplies the storage chamber 124 and the storage chamber 126 with a supply of positive pressure fluid, typically compressed air.

The actuator 108 is at least partially received by the housing 104 and includes a valve member 144 and a trigger 148. The valve member 144 is normally biased in a closed position and is movable to an open position. In the closed position, the valve member 144 fluidly decouples the storage chamber 124 and the storage chamber 126 from the connection chamber 132. In the open position, the valve member 144 fluidly couples the storage chamber 124 and the storage chamber 126 to the connection chamber 132.

The trigger 148 of the actuator 108 is pivotally connected to the housing 104 and is normally biased in a deactuated position in which the valve member 144 is maintained in the closed position. The trigger 148 is movable to an actuated position, which causes the valve member 144 to move to the open position for a period of time of sufficient length for the nailer to drive a nail N into a workpiece (not shown).

The connection chamber 132 extends from the actuator 108 to the valve assembly 112. Also, the connection chamber 132 is in fluid communication with a generally cylindrical drive chamber 190 through a port 152, as described further below.

Figure 2:
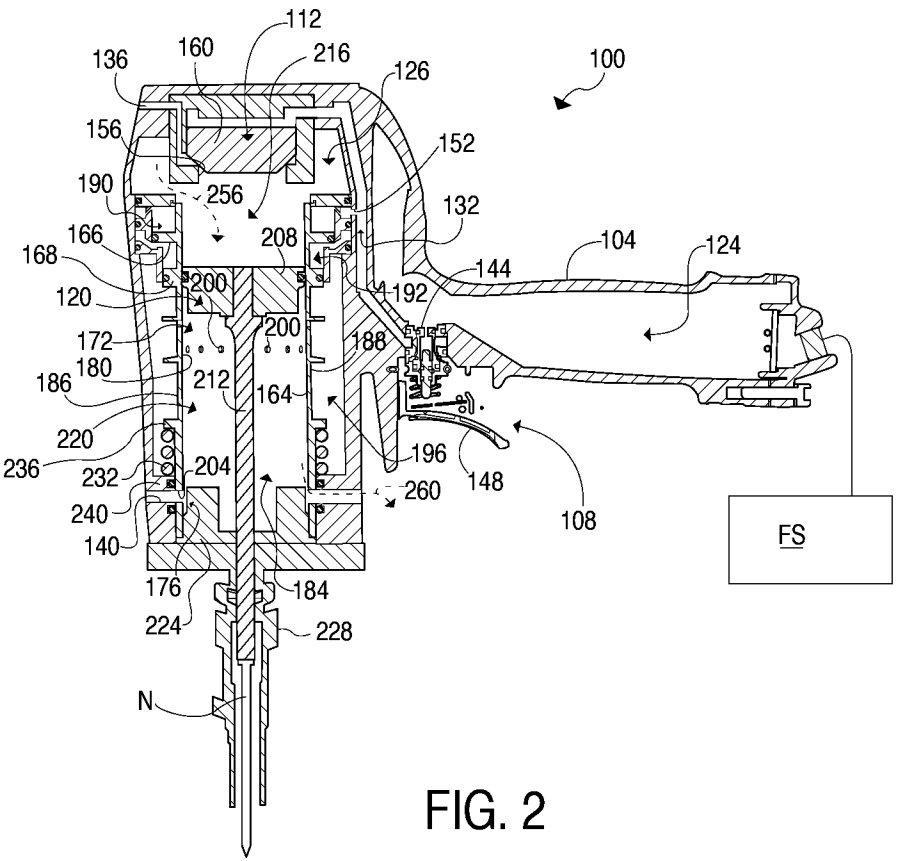
FIG. 2 is a cross sectional view of the pneumatic nailer of FIG. 1, shown with the cylinder in a second cylinder position and the piston positioned between the first piston position and a second piston position.
Figure 3:
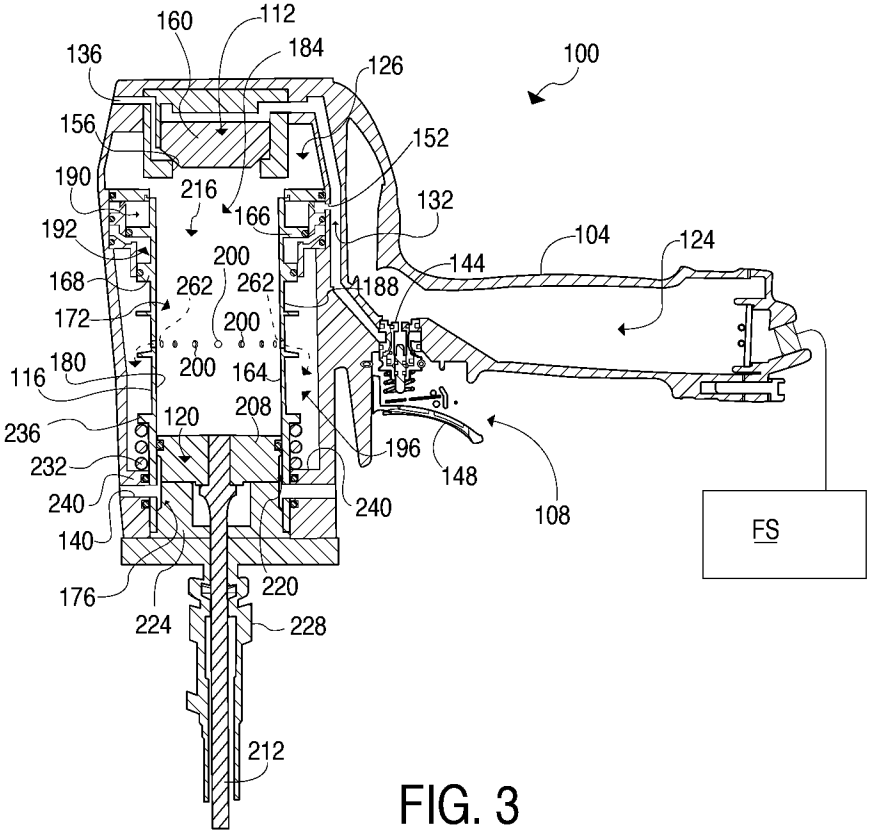
FIG. 3 is a cross sectional view of the pneumatic nailer of FIG. 1, shown with the cylinder in the second cylinder position and the piston in the second piston position.

With continued reference to FIG. 1, the valve assembly 112 is at least partially positioned within the housing 104 and includes a valve seat 156 and a plunger 160 that is movable relative to the valve seat. The valve assembly 112 is normally biased in a vented position (FIGS. 1 and 4) and is movable to an unvented position (FIGS. 2 and 3). When the valve assembly 112 is in the vented position, the plunger 160 is separated from the valve seat 156 to enable fluid flow from the valve seat through the vent passage 136 to atmosphere. When the valve assembly 112 is in the unvented position, the plunger 160 is seated against the valve seat 156 and fluid flow through the valve seat is prevented.

The cylinder 116 is positioned within the housing 104 and includes a sleeve 164, an actuating structure 166, an actuating structure 168, a check valve assembly 172, and a port assembly 176. The cylinder 116 is configured for movement with respect to the housing 104 between first cylinder position (FIGS. 1 and 4) and a second cylinder position (FIGS. 2 and 3).

The sleeve 164 includes a generally cylindrical and tubular portion of the cylinder 116. An inner side 180 of the sleeve 164 defines a sleeve chamber 184. The sleeve 164 is formed from aluminum. In another embodiment, the sleeve 164 is formed from another material, including, but not limited to, magnesium, steel, and plastic. The material forming the sleeve 164 may be machined, molded, drawn, forged, die cast, and/or injection molded to form the sleeve. When the cylinder 116 is in the first cylinder position, the sleeve 164 contacts the valve seat 156 and forms a fluid impervious seal.

The actuating structure 166 is fixed to an outer side 188 of the sleeve 164 and extends radially away therefrom. In particular, the actuating structure 166 extends around the circumference of the outer side 188 of the sleeve 164. The actuating structure 166 is positioned against a portion of the housing 104 and forms a fluid impervious seal that separates the drive chamber 190 from a generally cylindrical vent chamber 192. The vent chamber 192 is fluidly coupled to the storage chamber 124 and the storage chamber 126.

The actuating structure 168 is fixed to the outer side 188 of the sleeve 164 and extends radially away therefrom. The actuating structure 168 extends around the circumference of the outer side 188 of the sleeve 164. The actuating structure 168 is positioned against a portion of the housing 104 and forms a fluid impervious seal that separates the vent chamber 192 from a generally cylindrical actuating chamber 196, which extends between the actuating structure 168 and a generally circular shoulder 240 of the housing 104 and is bounded by the housing and the outer surface 188 of the sleeve 164.

The valve assembly 172 of the cylinder 116 is connected to the sleeve 164 and includes at least one check valve 200. Each of the check valves 200 enables fluid to flow from the sleeve chamber 184 into the actuating chamber 196, and each check valve prevents fluid flow from the actuating chamber into the sleeve chamber. The cylinder 116 includes approximately fourteen (14) of the check valves 200; however, other embodiments of the cylinder may include a different number of the check valves.

The port assembly 176 includes at least one port 204 extending through the sleeve 164. The cylinder 116 includes eight (8) of the ports 204; however, other embodiments of the cylinder may include a different number of the ports. When the cylinder 116 is positioned in the first cylinder position (FIGS. 1 and 4) the ports 204 fluidly couple the sleeve chamber 184 to the actuating chamber 196, and when the cylinder is positioned in the second cylinder position (FIGS. 2 and 3) the ports 204 fluidly couple the sleeve chamber to atmosphere through the vent port 140 of the housing 104.

Figure 4:
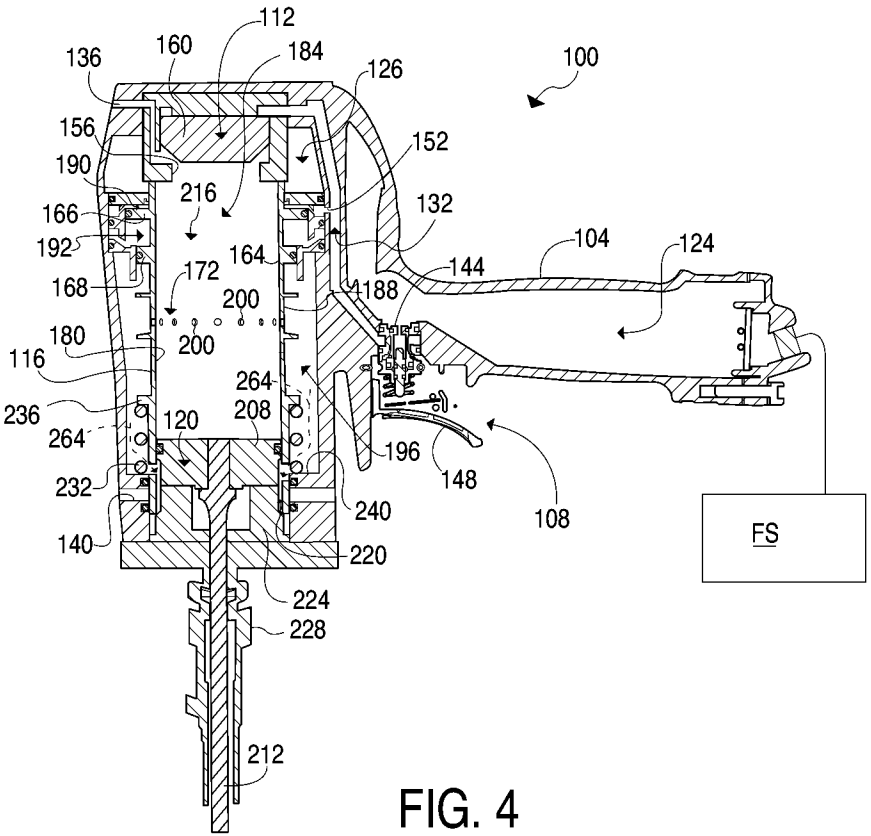
FIG. 4 shows a cross sectional view of the pneumatic nailer of FIG. 1, shown with the cylinder in the first cylinder position and the piston in the second piston position.

With continued reference to FIG. 1, the piston 120 includes a piston head 208 and a driver member 212. The piston head 208 is positioned in the sleeve 164 and is movable within the sleeve chamber 184 between a first piston position (FIG. 1) and a second piston position (FIGS. 3 and 4). The piston head 208 divides the sleeve chamber 184 into a generally cylindrical displacement chamber 216 (FIG. 2) and a generally cylindrical return chamber 220 (FIGS. 1 and 2). The displacement chamber 216 is located between the piston head 208 and the valve assembly 112. The return chamber 220 (FIGS. 1 and 2) located between the piston head 208 and a bumper member 224.

The driver member 212 is connected to the piston head 208 and extends into the return chamber 220. The driver member 212 extends out of the housing 104 through the bumper 224 and is positioned to contact one of the nails N held by a magazine 228 of the nailer 100.

The nailer 100 also includes a biasing member 232, which is at least partially positioned in the actuating chamber 196 between a shoulder 236 extending from the outer surface 188 of the sleeve 164 and the shoulder 240. The biasing member 232 includes a compression spring that is configured to bias the cylinder 116 toward the first cylinder position (FIGS. 1 and 4).

In operation, the nailer 100 efficiently uses compressed air from the fluid source FS to quickly drive the nail N into a workpiece (not shown). To drive the nail N, the nailer 100 is positioned with the nail above a desired nail location of the workpiece with the nailer configured in a deactivated arrangement, as shown in FIG. 1. Next, the trigger 148 is moved from the deactuated position to the actuated position, which causes the valve member 144 to move from the closed position (FIGS. 2 and 3) to the open position (FIGS. 1 and 4). When the valve member 144 is in the open position compressed air flows from the storage chamber 124 into the connection chamber 132 as shown by the flow path 244 of FIG. 1. The compressed air in the connection chamber 132 flows from the actuator 108 to the drive chamber 190 along the flow path 248 (FIG. 1) and to the valve assembly 112 along the flow path 252 (FIG. 1).

As shown in FIG. 2, when the compressed air enters the drive chamber 190 where it causes the cylinder 116 to move to the second cylinder position and compresses the biasing member 232. When the compressed air is received by the valve assembly 112, the plunger 160 moves toward the piston 120 to the unvented position, which terminates the fluid connection between the displacement chamber 216 and atmosphere.

With continued reference to FIG. 2, when the cylinder 116 is in the second cylinder position and the valve assembly 112 is in the unvented position, the compressed air in the storage chamber 126 flows into the sleeve chamber 184 and the displacement chamber 216, as shown by the flow path 256. The compressed air from the storage chambers 124, 126 forces the piston 120 to move toward the second piston position. The piston 120 is shown in FIG. 2 in an intermediate position between the first piston position and the second piston position.

As the piston 120 moves toward the second piston position its movement is substantially unrestricted by air present in the return chamber 220. Specifically, as the compressed air drives the piston 120 toward the second piston position, air within the return chamber 220 is evacuated to atmosphere through the port assembly 176 and the vent passage 140, as shown by flow path 260 (FIG. 2). The evacuation of air in the return chamber 220 enables the piston 120 to move quickly, efficiently, and forcefully to the second piston position. As the piston 120 moves to the second position, substantially none of the air below the piston is compressed; instead, the air below the piston is evacuated through the port assembly 176 and the vent passage 140, such that more energy is available to drive the nail N.

As shown in FIG. 3, when the piston 120 is in the second piston position, the valve assembly 172 is positioned in the displacement chamber 216. Accordingly, the compressed air flows through the check valves 200 of the valve assembly 172 into the actuating chamber 196, as shown by flow path 262 (FIG. 3). The actuating chamber 196, therefore, stores a quantity of the compressed air that is used to drive the piston to the second piston position. Also, as shown in FIG. 3, the driver member 212 of the piston 120 has contacted the nail N and evacuated the nail from the magazine 228 into the workpiece (not shown). The nailer 100 drives the nail N into the workpiece in only a fraction of a second after the trigger 148 is moved to the actuated position.

After the piston 120 is in the second piston position, the valve 144 of the actuator 108 closes and isolates the valve assembly 112 from the storage chambers 124, 126, thereby causing the plunger 160 to move away from the piston to the vented position. Also, the drive chamber 190 becomes isolated from the storage chambers 124, 126 and becomes fluidly coupled to atmosphere through a vent opening (not shown) in the housing 104. Accordingly, the force maintaining the cylinder 116 in the second cylinder position is significantly reduced, thereby enabling the biasing member 232 and the supply of compressed air in the actuation chamber 196 to bias the cylinder to the first cylinder position (FIGS. 1 and 4). The vent opening described above, but not shown, may alternatively be formed in the trigger 148 or in a combination of the housing 104 and the trigger.

With reference to FIG. 4, which shows the cylinder 116 after it has moved back to the first cylinder position and the piston 120 in the second piston position, the ports 204 of the port assembly 176 fluidly couple the actuating chamber 196 to the return chamber 220. The configuration of the nailer 100 shown in FIG. 4 causes the compressed air stored in the actuating chamber 196 to rush into the return chamber 220 through the ports 204 (along flow path 264 (FIG. 4)) and to exert a force on the piston 120, which causes the piston to move to the first piston position. Accordingly, the nailer 100 uses a portion of the compressed air that was used to drive the piston 120 to the second piston position, to return the piston to the first piston position and to prepare the nailer to drive another one of the nails N. As a result, the overall air consumption of the nailer 100 is less than other nailers, which use compressed air directly from the supply chambers 124, 126 to return the piston 120 to the first piston position.

The piston 120 encounters substantially no air resistance as it returns to the first piston position, since the vent assembly 112 couples the displacement chamber 216 to atmosphere to enable the piston to evacuate air in the displacement chamber to atmosphere through the vent passage 136. When the piston 120 reaches the first piston position the nailer 100 is ready to drive the next nail N in the magazine 228.

While the invention has been illustrated and described in detail in the drawings and foregoing description, the same should be considered as illustrative and not restrictive in character. It is understood that only the preferred embodiments have been presented and that all changes, modifications and further applications that come within the spirit of the invention are desired to be protected.

What is claimed is:

1. A pneumatic nailer for use with a fluid source, comprising:

a housing defining a storage chamber configured for fluid communication with the fluid source;

a cylinder having a sleeve, an actuating structure fixed to said sleeve, a first valve assembly carried by said sleeve, and at least one port defined in said sleeve, said cylinder configured for movement with respect to said housing between a first cylinder position and a second cylinder position, an inner side of said sleeve defining a sleeve chamber, an outer side of said sleeve and said housing defining an actuating chamber therebetween on a first side of said actuating structure, and said first valve assembly configured to (i) to allow fluid flow from said sleeve chamber to said actuating chamber and (ii) to prevent fluid flow from said actuating chamber to said sleeve chamber;

a piston having a piston head and a driver member extending from said piston head, said piston head being movable within said sleeve chamber between a first piston position and a second piston position, said sleeve and said piston head defining (i) a displacement chamber on a first side of said piston head and (ii) a return chamber on an opposite side of said piston head, said at least one port configured and arranged (i) to fluidly couple said return chamber to said return chamber to said actuating chamber when said cylinder is in said first cylinder position and (ii) to fluidly couple said return chamber to atmosphere when said cylinder is in said second cylinder position; and a second valve assembly at least partially positioned within said housing and moveable between a first valve position and a second valve position, said second valve assembly configured (i) to fluidly couple said displacement chamber to atmosphere when said second valve assembly is in said first valve position and (ii) to isolate said displacement chamber from atmosphere when said second valve assembly is in said second valve position; and an actuator positionable between an actuated position and a deactuated position and configured such that (i) when said actuator is moved from said deactuated position to said actuated position said second valve assembly is caused to move from said first valve position to said second valve position and (ii) when said actuator is moved from said actuated position to said deactuated position said second valve assembly is caused to move from said second valve position to said first valve position.

2. The pneumatic nailer of claim 1 further comprising a biasing member at least partially positioned within said actuating chamber and configured to bias said cylinder toward said first cylinder position.

3. The pneumatic nailer of claim 2, wherein said biasing member is positioned between a first shoulder of said cylinder and a second shoulder of said housing.

4. The pneumatic nailer of claim 1, wherein said first valve assembly includes at least one check valve.

5. The pneumatic nailer of claim 1, wherein:

said actuating chamber is configured to store a portion of fluid from the fluid source, and said at least one port is configured to transfer said portion of fluid to said return chamber when cylinder is in said first cylinder position.

6. The pneumatic nailer of claim 5, wherein said piston moves to said first piston position in response to said at least one port transferring said portion fluid to said return chamber.

7. The pneumatic nailer of claim 1, wherein said housing defines a first vent passage configured to fluidly couple said displacement chamber to atmosphere when said second valve assembly is in said first valve position.

8. The pneumatic nailer of claim 7, wherein said housing defines a second vent passage configured to fluidly couple said return chamber to atmosphere through said at least one port when said cylinder is in said second cylinder position.

9. A pneumatic nailer for use with a fluid source, comprising:

a housing defining a storage chamber configured for fluid communication with the fluid source;

a cylinder configured for movement with respect to said housing between a first cylinder position and a second cylinder position, an inner side of said cylinder defining a sleeve chamber and an outer side of said cylinder and said housing defining an actuating chamber therebetween;

a first valve assembly carried by said cylinder and configured (i) to allow fluid flow from said sleeve chamber to said actuating chamber and (ii) to prevent fluid flow from said actuating chamber to said sleeve chamber;

a piston having a piston head and a driver member extending from said piston head, said piston head being movable within said sleeve chamber between a first piston position and a second piston position, said cylinder and said piston head defining (i) a displacement chamber on a first side of said piston head and (ii) a return chamber on an opposite side of said piston head; and at least one port formed in said cylinder and configured and arranged (i) to fluidly couple said return chamber to said actuating chamber when said cylinder is in said first cylinder position and (ii) to fluidly couple said return chamber to atmosphere when said cylinder is in said second cylinder position.

10. The pneumatic nailer of claim 9 further comprising a second valve assembly at least partially positioned within said housing and moveable between a first valve position and a second valve position, said second valve assembly configured (i) to fluidly couple said displacement chamber to atmosphere when said second valve assembly is in said first position and (ii) to isolate said displacement chamber from atmosphere when said second valve assembly is in said second position.

11. The pneumatic nailer of claim 10 further comprising an actuator positionable between an actuated position and a deactuated position and configured such that (i) when said actuator is moved from said deactuated position to said actuated position said second valve assembly is caused to move from said first position to said second position and (ii) when said actuator is moved from said actuated position to said deactuated position said second valve assembly is caused to move from said second position to said first position.

12. The pneumatic nailer of claim 11 further comprising a biasing member at least partially positioned within said actuating chamber and configured to bias said cylinder toward said first cylinder position.

13. The pneumatic nailer of claim 12, wherein said biasing member is positioned between a first shoulder of said cylinder and a second shoulder of said housing.

14. The pneumatic nailer of claim 9, wherein said first valve assembly. includes at least one check valve.

15. The pneumatic nailer of claim 9, wherein:

said actuating chamber is configured to store a portion of fluid from the fluid source when said cylinder is in said second position, and said at least one port transfers said portion fluid to said return chamber when cylinder is in said first cylinder position.

16. The pneumatic nailer of claim 15, wherein said piston moves to said first piston position in response to said at least one port transferring said portion of fluid to said return chamber.

* * * * *